US005763796A

United States Patent [19]

Britto et al.

[11] Patent Number: 5,763,796

[45] Date of Patent: Jun. 9, 1998

[54] ROTATING FABRIC-COVERED BOX

[75] Inventors: James Joseph Britto, Westport, Mass.; Lai Ying Wong, Sai Ying Pun, Hong Kong

[73] Assignee: The First Years Inc., Avon, Mass.

[21] Appl. No.: 739,118

[22] Filed: Oct. 25, 1996

[51] Int. Cl.[6] ..... G10F 1/06

[52] U.S. Cl. ..... 84/95.2; 40/455; 446/265; 446/404; 446/297

[58] Field of Search ..... 84/95.2, 94.2, 84/95.1, 94.1; 40/455, 456, 457; 446/265, 298, 297, 404

[56] References Cited

U.S. PATENT DOCUMENTS 901,762 10/1908 Wetzel ..... 446/297

3,921,331 11/1975 Schatz ..... 446/297

4,910,897 3/1990 Hsu ..... 84/95.2

*Primary Examiner*—Cassandra C. Spyrou

*Attorney, Agent, or Firm*—Fish & Richardson P.C.

[57] ABSTRACT

A box having a base, a top rotatable relative to the base, and a motor connected within the box to the base and the top for causing the relative rotation thereof. The base and top are each covered with fabric secured thereto within the interior of the box. A retainer is connected to one of the base and top, positioned within the box and holding the fabric coverings substantially apart for reduced rotary friction. Resilient locking members secure the retainer to the top and the top to the base. In a preferred embodiment, the motor is a music-playing mechanism.

15 Claims, 7 Drawing Sheets

ROTATING FABRIC-COVERED BOX

BACKGROUND OF THE INVENTION

This invention relates to fabric-covered boxes with rotating members.

Toys for small children are frequently encased in soft fabric for decorative effect or to protect small hands from hard or sharp surfaces. Sometimes toys are provided with rotating parts to amuse and entertain infants, but the mechanics of rotation typically require a gap between relatively rotating surfaces, and even small gaps between hard surfaces can pinch small fingers. Relative rotation between fabric surfaces requires higher torque due to the higher sliding friction between fabrics, and tends to wear the fabric surfaces.

SUMMARY OF THE INVENTION

In one aspect the invention comprises a box that provides two relatively rotating fabric-covered parts in which sliding friction is reduced or avoided between the two parts without providing an exposed gap or hard surfaces.

In one aspect of the invention, a box is provided having a base, a top rotatable relative to the base, and a motor within the box, connected to the base and the top for causing the relative rotation thereof. The base and the top are each covered with fabric, the fabric being secured within the interior of the box. A retainer is connected to one of the base and top. The fabric covering the one of the base and top is positioned between the retainer and the one of the base and top and held away from the adjacent edge of the other of the base and top by the retainer.

In some embodiments the retainer advantageously has locking members extending toward the one of the base and top that engage mating ledges in openings on the one of the base and top to secure the retainer to the one of the base and top. In some cases, the locking members comprise resilient fingers, the fingers having outwardly facing cam surfaces at their distal ends that engage the edges of holes in the one of the base and top. Preferably, the retainer has a wall extending toward the one of the base and top, and the fabric is secured to the retainer about the wall. In a current configuration, the wall has a stop which abuts an inner surface of the one of the base and the top.

In some embodiments of the invention, a shaft of the one of the base and top extends through a hole in the retainer. In some cases, the radial alignment of the top and base is maintained by the shaft extending through a concentric tube of the other of the base and top. Preferably, the shaft has resilient fingers with outwardly facing cam surfaces that engage an end of the tube to secure the top to the base.

In a presently preferred arrangement, the base and top are substantially circular and approximately the same size.

The motor, in some instances, comprises a music-playing mechanism arranged such that rotating the top with respect to the base activates the music-playing mechanism.

In a preferred arrangement, the facing sides of the base and top have upstanding circular walls. The walls extend towards each other and one of the walls has a recess arranged in close proximity to the distal edge of the other the wall. Preferably, the fabric material covering the facing sides of the base and top is elastic.

Advantageously, the invention is easy and inexpensive to assemble, has no exposed hard or sharp surfaces, is easy to operate without exposed pull cords, and has no undesirably exposed significant gaps. In embodiments that employ a music playing mechanism as the motor, the box can be rotated by the torque produced by common wind-up musical mechanisms due to the low friction between the rotating components.

DESCRIPTION OF THE PREFERRED EMBODIMENT

Figure 1:
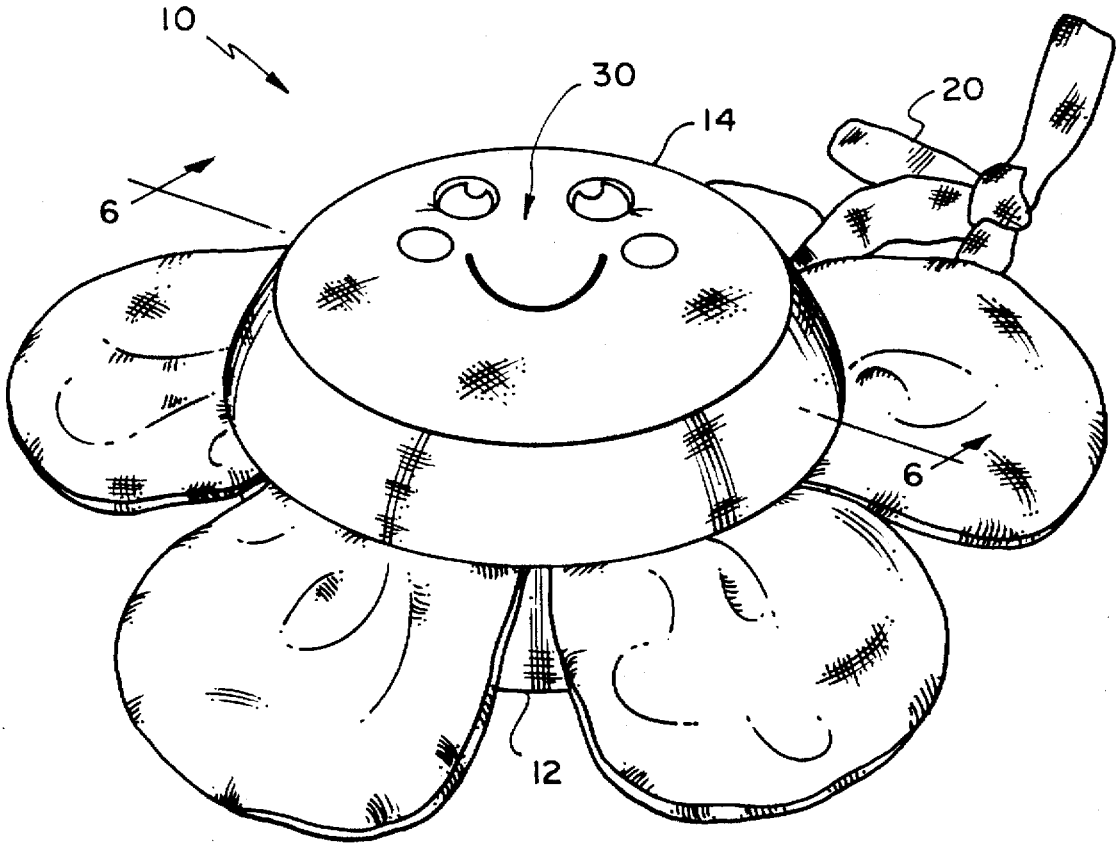
FIG. 1 is a perspective view of a box according to the invention.
Figure 2:
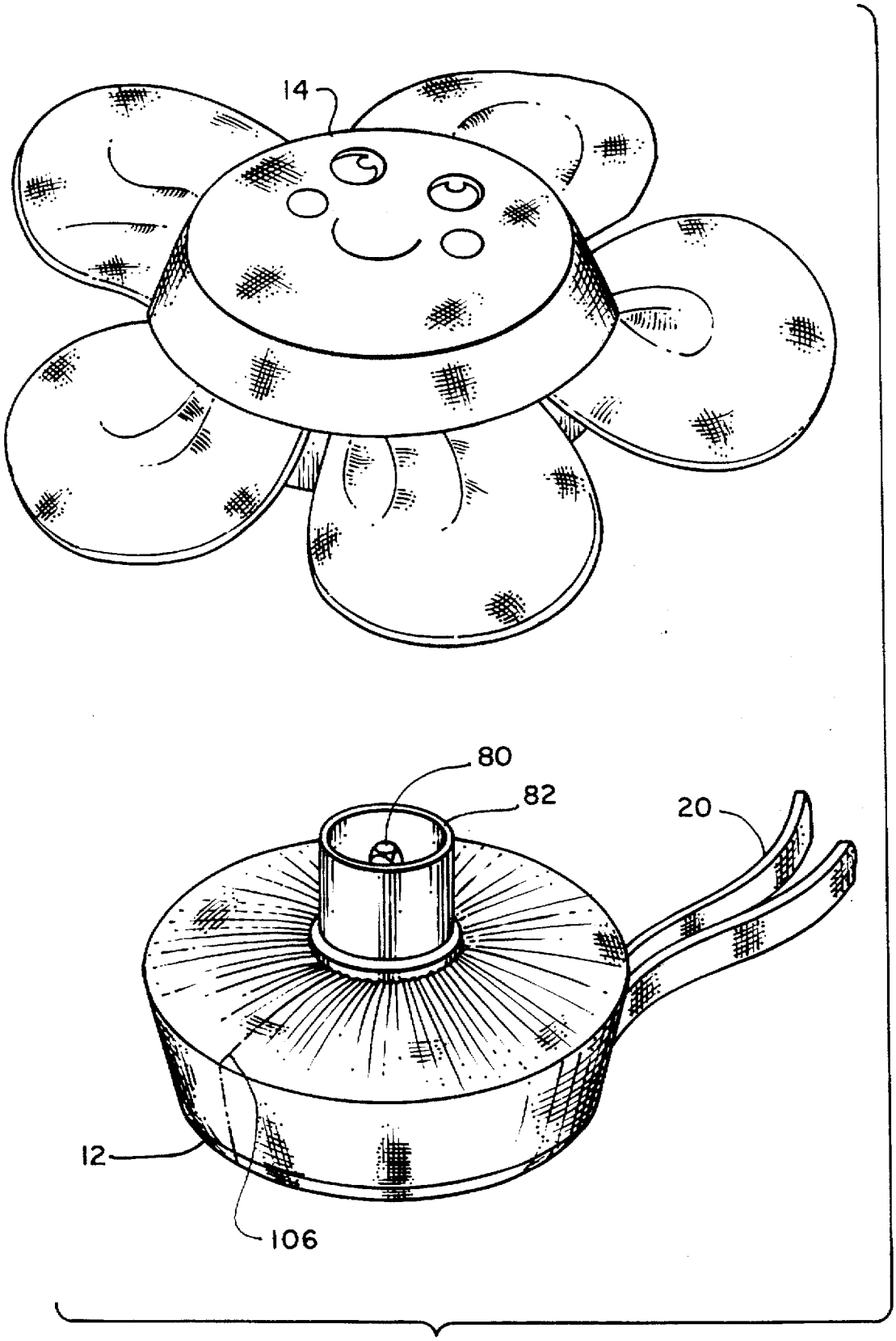
FIG. 2 is an exploded perspective view of the box.

The figures illustrate a preferred embodiment of the invention. As shown in FIGS. 1 and 2, a fabric covered box 10 includes a base 12 and a top 14, each covered with fabric. The base contains a common music-playing mechanism (FIG. 3).

Referring first to FIGS. 1 and 2, the fabric covering 30 of the top 14 is stylized to be attractive. The top 14 and base 12 are both circular, and are held in relative spacing to each other, as will be described later. The base has a pair of cloth strips 20 extending from a side surface, which can be employed to suspend the box from the edge of a child's crib, for instance.

The top 14 is rotatable with respect to the base 12 about a common axis in one direction to wind up a music-playing mechanism motor 22 (FIG. 6) of the base. With the motor wound up, the top can be released to rotate as the music mechanism plays music.

Figure 3:
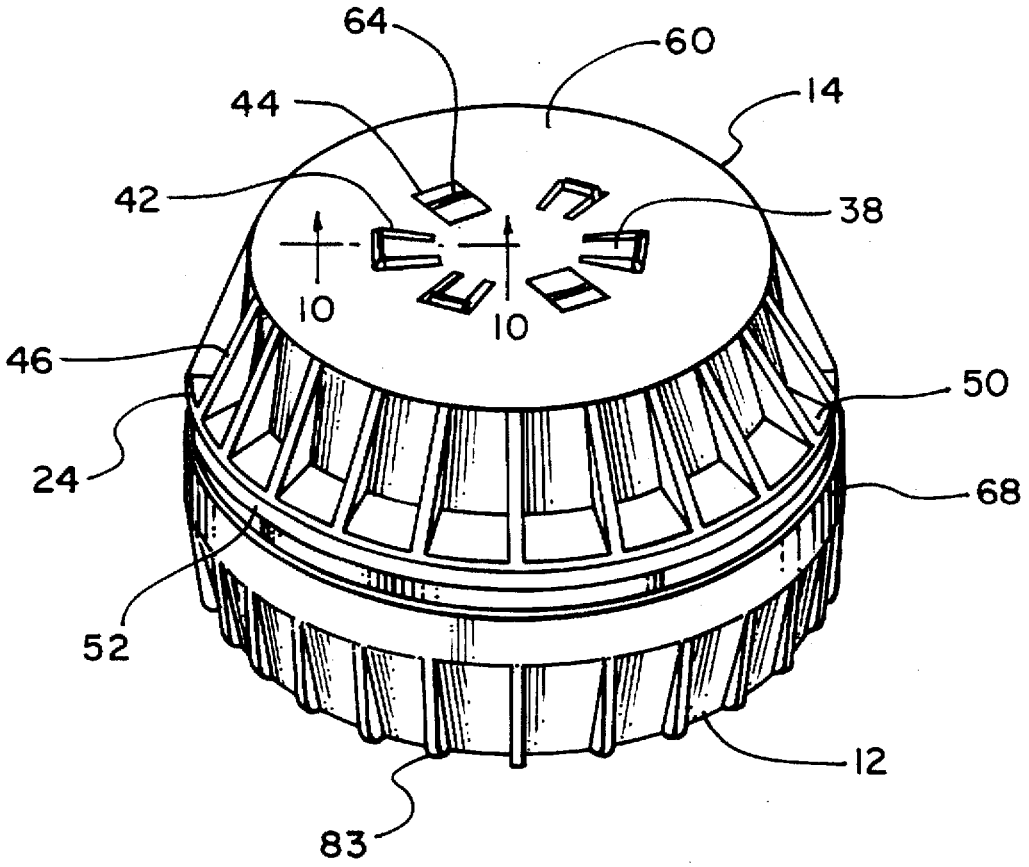
FIG. 3 is a perspective view of the box with the fabric coverings removed.
Figure 4:
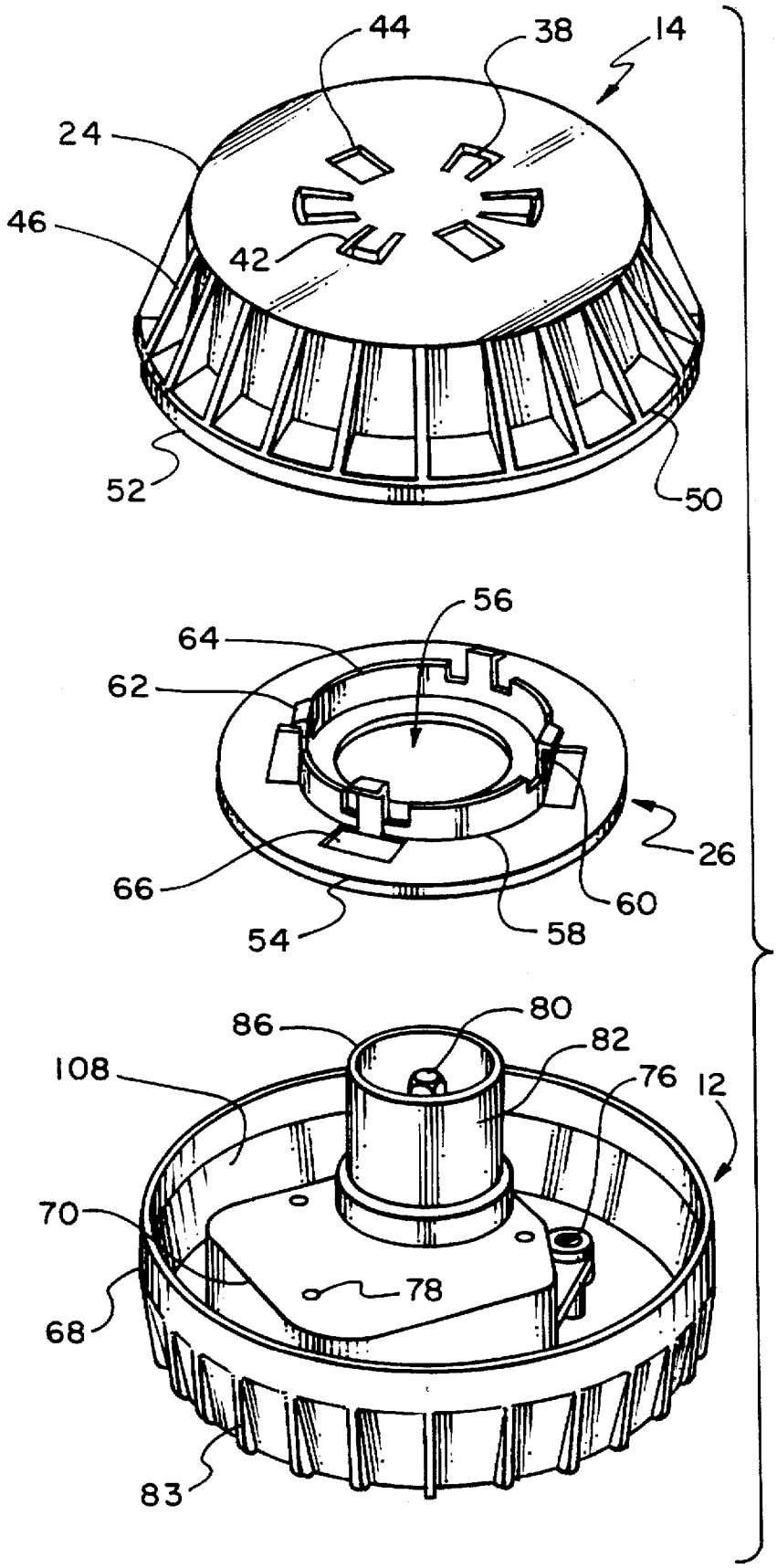
FIG. 4 is an exploded perspective view of the box with the fabric coverings removed.
Figure 5:
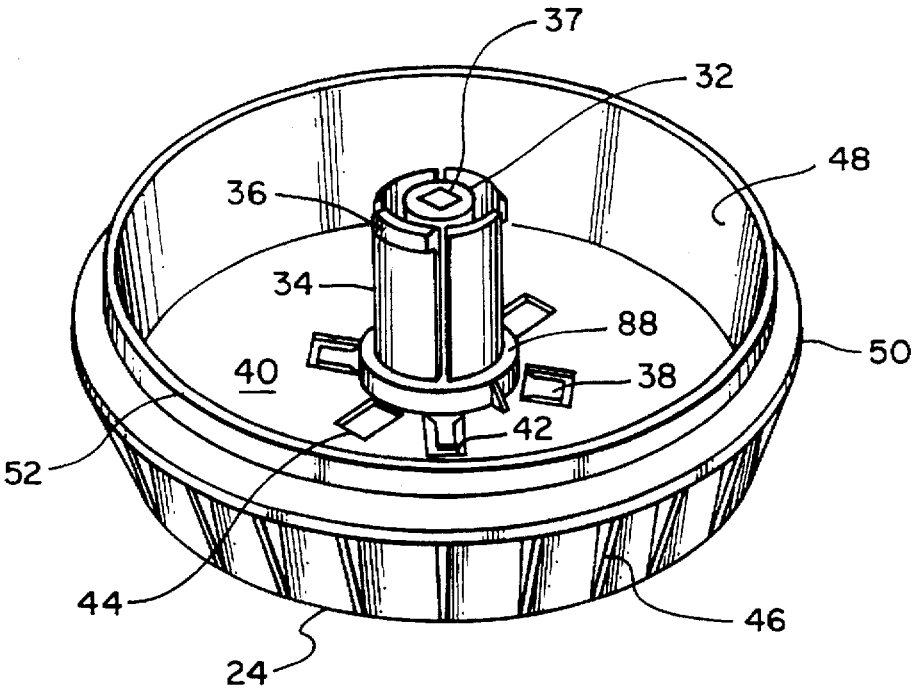
FIG. 5 is a perspective view of the top member, from the base-facing side.

FIGS. 3 through 5 illustrate the inner components of the box 10, with the fabric coverings removed to show a top member 24, a retainer 26, and a base member 68.

Figure 6:
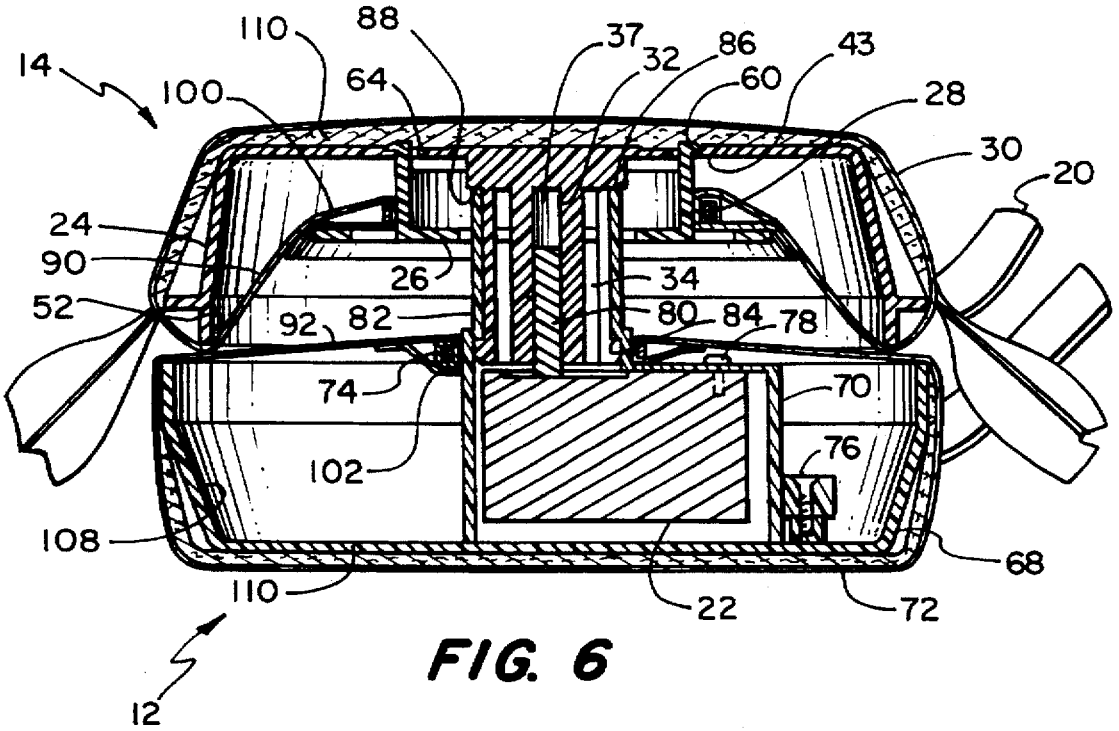
FIG. 6 is a cross-sectional view of the box, taken along line 6—6 in FIG. 1.

As perhaps best seen in FIG. 6, the top 14 comprises a molded plastic top member 24, a unitary molded plastic retainer 26, a plastic tie 28, and a fabric covering 30. The top member (FIG. 5) is generally bowl-shaped with an integral shaft 32 extending from the open side toward the base, surrounded by four resilient fingers 34, two with outwardly facing cam surfaces 36 at their distal ends. An axial square hole 37 within the shaft 32 receives the square shaft 80 of the motor 22 of the base 12. Four cantilever tabs 38 are molded within the plane of the broad face 40 of the top member, extending into openings 42. The broad face of the top member has two additional openings 44. Side ribs 46 about the periphery of the top provide increased rigidity to the side wall 48 and an outwardly extending lip 50 near the open edge of the top member 24. An axially extending recessed portion 52 of the side wall extends beyond the lip toward the base.

Figure 10:
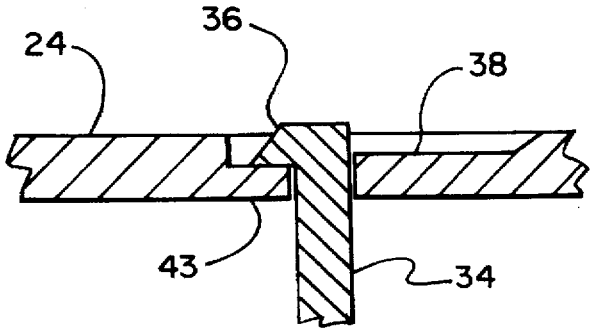
FIG. 10 is a fragmentary cross-sectional view, taken along line 10—10 in FIG. 3.

The retainer 26 is a separately molded piece, comprising a flat circular plate 54 with a central hole 56. A circular axially extending wall 58 extends from one face of the plate toward the top member 24, containing four upstanding resilient fingers 60 with outwardly facing cam surfaces 62 on their distal ends. Slots 66 adjacent the fingers 60 augment their cantilevered length. The fingers on the retainer are arranged such that their cam surfaces will engage ledges 43 (FIG. 10) within the tab-enclosing holes 42 in the face of the top member 14, the fingers 60 resiliently deforming, to secure the retainer 26 to the top member with the outer surface of the wall 58 abutting the inner side of the broad face 40 of the member and the frame fingers 34 and shaft 32 freely extending through the hole 56 in the retainer. The fingers extend beyond the wall 58 to an extent that the axial distance between the outer edge 86 of the wall and the underside of the cam surfaces 62 is approximately equal to the engaged thickness of the ledge 43, and the ledges 43 are recessed from the outer surface of the top member 24 a distance approximately equal to the thickness of the upper cammed portion of the fingers 60. This construction enables the retainer 26 to be permanently attached to the top member 14 by simply pressing it into place Thus secured, the distal ends of the fingers 60 are approximately within the plane defined by the outer surface of the top member 24, and must be pried away from the ledges 43 to remove the retainer from the top member.

The base 12 comprises a molded plastic base member 68, a music-playing mechanism or motor 22, a molded motor housing 70, a fabric covering 72, a plastic tie 74, and fasteners 76 and 78. The motor 22 is diagrammatically illustrated as a solid volume for simplicity, but should be understood to be, in a preferred embodiment, a common spring-wound music playing mechanism, of the type that generate a musical tune by turning a cylinder containing pegs that pluck cantilevered fingers in an arranged pattern. A square shaft 80 extending upward from the music-playing mechanism provides a means to wind up the motor to power the mechanism.

The music-playing mechanism 22 is secured within the motor housing 70 with threaded fasteners 78, arranged such that the square drive shaft 80 of the mechanism extends concentrically through an upper tube portion 82 of the housing 70. The housing is fastened against the inner face of the generally bowl-shaped base member 68 with self-tapping fasteners 76. The base member has outwardly facing ribs 83 about the outside of side wall 108 to add rigidity.

The tube portion 82 of the housing 70 has an internal step 84 at the inner end that engages the cam surfaces 36 at the distal ends of the top member fingers 34 to secure the top 14 to the base 12. To assemble the top to the base, the shaft 32 and fingers 34 of the top section are pushed into the tube portion 82 of the motor housing 70 of the base. Because the distance between the outer edges of the cam surfaces of fingers 34 is slightly greater than the inner diameter of the tube portion, the fingers will resiliently deform inward as the top is pressed toward the base, until their cam surfaces 36 engage the inner step 84 at the base of the tube portion and the distal end 86 of the tube portion abuts a ledge 88 at the base of the fingers 34. This construction results in the force required to assemble the top to the base being much less than the force required to pull them apart.

In one embodiment, the fabric coverings 30 and 72 of the top and base, respectively, are polyester tricott, with the inner portions 90 and 92 of the coverings that extend over the facing sides of the top and base an elastic, stretchable spandex material to maintain a residual tension upon assembly that helps to reduce the rotating frictional contact between the top covering 30 and the base covering 72.

Figure 7:
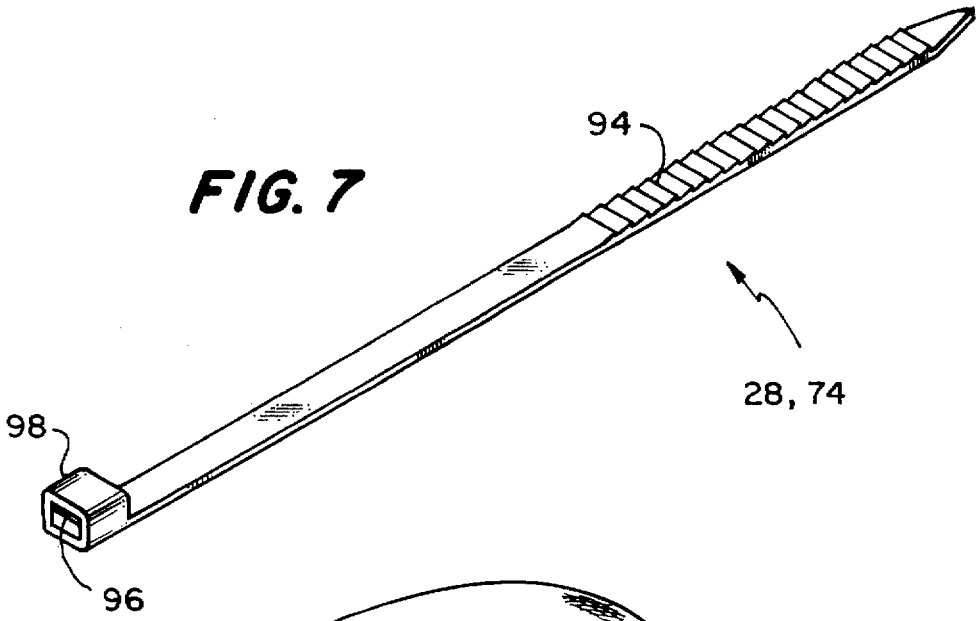
FIG. 7 is a perspective view of a plastic tie.

The coverings 30 and 72 are secured to the top member 24 and base member 68 with plastic ties 28 and 74, respectively. These ties are the common locking plastic variety, as shown in FIG. 7, which contains a series of ridges along one face that sequentially engage a lip 96 within a hasp 98 at one end of the tie as the other end of the tie is pushed through the hasp. The ties are disposed within tie loops 100 and 102 at the open edges of the stitched coverings.

Figure 8:
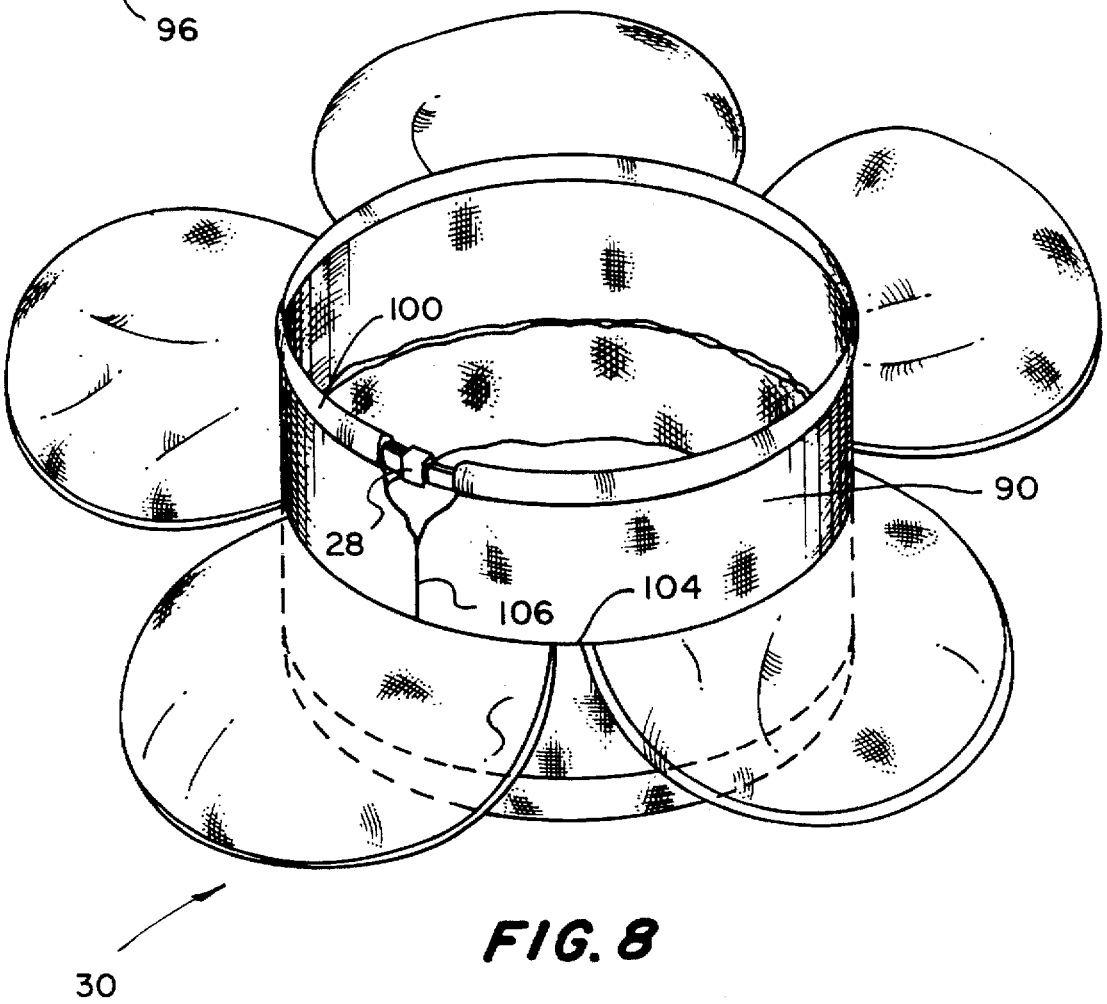
FIG. 8 is a perspective view of a pre-assembled form of the top fabric covering.

Before assembly to the top and base, the coverings 30 and 72 are sewn into bag form, as shown in FIG. 8, with a loop at the top of the bag, such as in a bag with a drawstring. The upper portion (90 or 92) of the bag, which will cover the inner face of the top or base, is spandex, joined to a stiffer weave fabric at stitch seam 104. The ties (28 or 74) are inserted into the tie loops (100 or 102) through an opening at the longitudinal seam 106.

To assemble the base covering 72 to the base member 68, the base member is placed in the bag formed by the base covering 72, with the open side of the base facing the open end of the bag. The open end of the tie 74 is drawn through the tie hasp 98, closing the open end of the fabric covering bag around the tube portion 82 of the motor housing 70 and stretching the spandex material 92 tightly across the face of the base 12. When the tie is snug about the base of the tube portion, any extraneous length of the tie is removed. In this manner, the fabric covering 72 completely encloses the base member 68 and housing 70, with only the tube portion 82 unenclosed.

Figure 9:
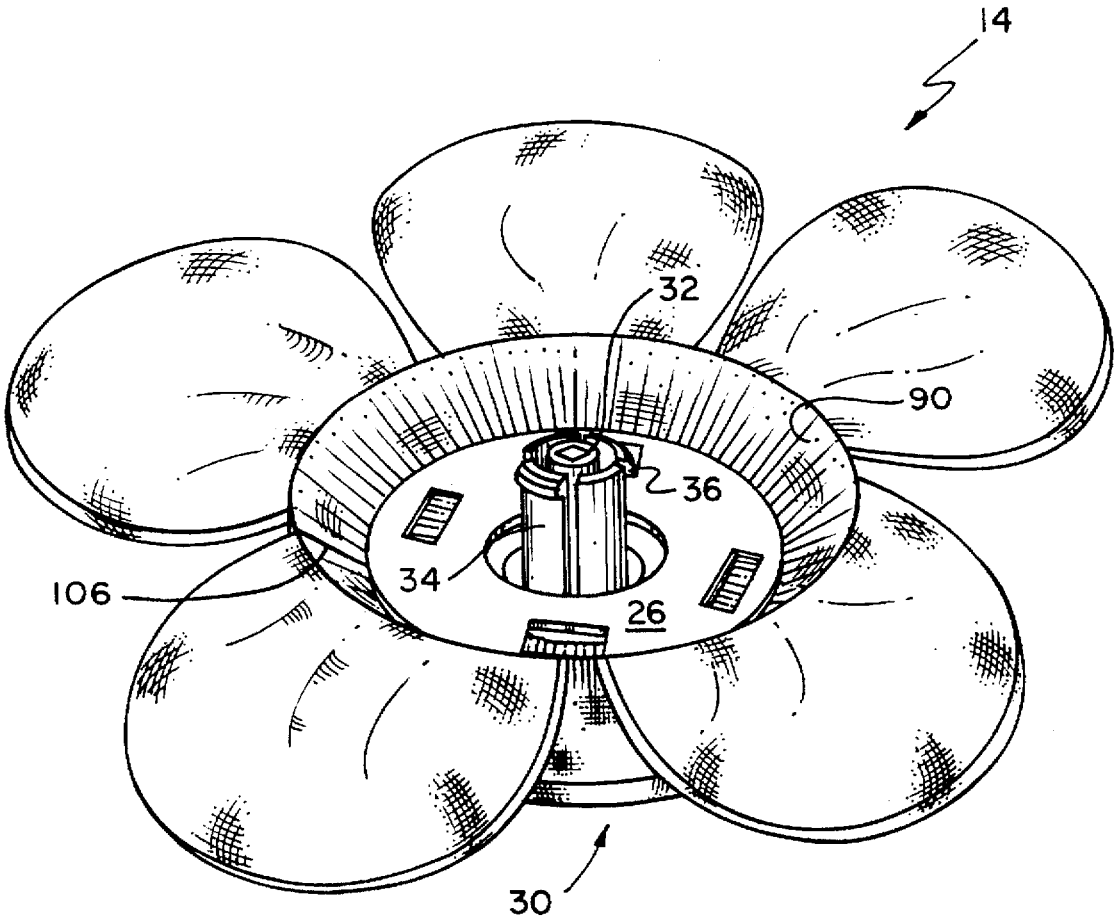
FIG. 9 is a perspective view of the top, from the base-facing side.

The top fabric covering 30 is assembled to the top member 14 in a similar manner, except that the tie 28 is closed about wall 58 at the base of the fingers 60 on the retainer 26 prior to securing the retainer to the top member. The retainer 26 is positioned about the distal end of the top shaft 32, and the tie 28 closed about the circular upstanding wall 58 of the retainer, at the base of the retainer fingers 60. Any extraneous length of the tie is removed, and the retainer is pushed toward the top member to engage the locking fingers 60 and secure the retainer to the top, positioned as shown in FIG. 9.

The retainer 26 thus keeps the fabric 90 covering the inner face of the top 14 away from the fabric 92 covering the inner face of the base 12, reducing the effective rotary friction between the top and base. The elasticity of the facing fabric surfaces 90 and 92 enables the fabric to stretch as the ties 28 and 74 are closed, leaving residual tension in the facing fabric surfaces that further reducing the friction between them.

The outer portion 52 of the side wall 48 of the top member 14 extends close enough to the stretched spandex material 92 of the base 12 to disallow any substantial gap between the relatively rotating top and base. The retainer 26 holds the spandex material 90 away from the spandex material 92 of the base to reduce friction.

This construction provides a box 10 with two parts 12 and 14 that relatively rotate with low frictional drag and without a substantially open gap between them that can pose a hazard to small fingers.

To further soften the feel of the box, in some embodiments padding 110 is disposed between the outer fabric surfaces 30 and 72 and the top and base members, 24 and 68, respectively.

Other embodiments and improvements will occur to those skilled in the art, and are within the scope of the claims. The motor, for example, could be an electric motor and, further, could be battery operated.

What is claimed is:

1. A box having a base, a top rotatable relative to the base, and a motor within said box, connected to the base and the top for causing the relative rotation thereof;

said base and said top each covered with fabric, the fabric covering each of the base and the top being secured thereto within the interior of said box; and a retainer connected to one of said base and said top, the fabric covering one of said base and said top positioned between the retainer and said one of said base and said top, and held away from the adjacent edge of the other of said base and said top by said retainer.

2. The box of claim 1 in which the retainer has locking members extending toward said one of said base and top that engage mating ledges in openings on said one of said base and top to secure said retainer to said one of said base and top.

3. The box of claim 2 in which the locking members comprise resilient fingers, the fingers having outwardly facing cam surfaces at their distal ends that engage the edges of the openings in said one of said base and top.

4. The box of claim 2 in which the retainer comprises a wall extending toward said one of said base and top, the fabric secured to said retainer about said wall.

5. The box of claim 4 in which the wall comprises a stop which abuts an inner surface of said one of said base and said top.

6. The box of claim 1 in which a shaft of said one of said base and top extends through a hole in said retainer.

7. The box of claim 6 in which the radial alignment of said top and base is maintained by said shaft extending through a concentric tube of the other of said base and top.

8. The box of claim 6 in which the shaft has resilient fingers with outwardly facing cam surfaces that engage an end of the tube to secure the top to the base.

9. The box of claim 6 in which the base and top are substantially circular and approximately the same size.

10. The box of claim 1 in which the motor comprises a music-playing mechanism arranged such that rotating the top with respect to the base activates the music-playing mechanism.

11. The box of claim 1 in which the facing sides of said base and top comprise upstanding circular walls, the walls extending towards each other and one of said walls having a recess arranged in close proximity to the distal edge of the other said wall.

12. The box of claim 1 in which the radial alignment of said top and base is maintained by a shaft of the top extending through a concentric tube of the base.

13. The box of claim 12 in which the shaft has resilient fingers with outwardly facing cam surfaces that engage an end of the tube to secure the top to the base.

14. The box of claim 1 in which the base and top are substantially circular and approximately the same size.

15. The box of claim 1 in which the fabric material covering said facing sides of said base and top is elastic.

* * * * *